United States Patent [19]

Wessman

[11] Patent Number: 4,692,125

[45] Date of Patent: Sep. 8, 1987

[54] SWIMMING AND BATHING AID

[76] Inventor: Börje Wessman, Korsuddsvägen 19, Saltsjö-Boo S-13200, Sweden

[21] Appl. No.: 898,861

[22] PCT Filed: Sep. 23, 1983

[86] PCT No.: PCT/EP83/00248

§ 371 Date: Jun. 27, 1984

§ 102(e) Date: Jun. 27, 1984

[87] PCT Pub. No.: WO84/01757

PCT Pub. Date: May 10, 1984

Related U.S. Application Data

[63] Continuation of Ser. No. 626,832, Jun. 27, 1984, abandoned.

[30] Foreign Application Priority Data

Oct. 28, 1982 [DE] Fed. Rep. of Germany ..... 3239924

[51] Int. Cl.[4] ..... A63B 31/00

[52] U.S. Cl. ..... 441/112; 441/108; 441/113; 441/122

[58] Field of Search ..... 441/108, 111, 112, 113, 441/114, 115, 116, 117, 118, 122

[56] References Cited

U.S. PATENT DOCUMENTS 1,734,619 11/1929 Gates ..... 441/111

*Primary Examiner*—Jeffrey V. Nase
*Assistant Examiner*—Thomas J. Brahan
*Attorney, Agent, or Firm*—Dority & Manning

[57] ABSTRACT

The invention relates to a swimming and bathing aid especially for young children with a chest ring 19 and with two arm floating elements 17, 18 which are connected with the chest ring 19. The chest ring has such a volume that it creates along the buoyancy necessary for swimming. The arm floating elements (17,18) do not dip into the water in a static swimming position and they are used as balancing elements against lateral swimming movements. For this the arm floating elements extend in a sideward upper direction from the upper arms (34, 35) and they are connected with the upper arms (34, 35) and with the chest ring (19). The chest ring (19) is divided at its rear side by a gap so that it can be adapted to different chest dimensions. The chest ring (19) is held together by a strip (30) which forms with the strips (26,27) a harness in which the arm floating elements (17, 18) the chest ring (19) and a child (33) are contained. Neither the arm floating elements (17, 18) nor the chest ring (19) can be stripped off by a child because of the connection of chest ring (19) and arm floating elements (17,18). In the water there is a vertical "standing" swimming position which is natural for young children and which causes less anxiety and which is most suitable for bathing and games.

18 Claims, 7 Drawing Figures

SWIMMING AND BATHING AID

This is a continuation, of application Ser. No. 06/626,832, filed June 27, 1984, which was abandoned upon the filing hereof.

The invention relates to a swimming and bathing aid especially for young children.

Swimming and bathing aids are known in various embodiments. All swimming and bathing aids are based on the principal of increasing the buoyancy of the human body by connecting it with lift augmenting elements. The known swimming and bathing aids differ therefore in material, in shape and in the size of the lift augmenting elements, in their arrangement on the human body and in the way they are connected to the human body.

A swimming ring is a toroidal inflated ring which is worn round the chest under the armpits. The bather, normally a non swimmer, hangs thereby with his upper arms on the ring which floats on the surface of the water and the swimmer is therefore greatly restricted in his movements. Here exists the danger that especially children slide out of the ring, when moving or they may overturn headfirst. In general swimming rings have only one inflatable chamber so that by a contact with pointed or sharp objects the air may escape and there is a danger that the bather will go down. A swimming ring is therefore a very insecure swimming and bathing aid. Especially for young children who are not yet able to swim such a device is absolutely unsuited, for example in a swimming pool when the children are not taken care of intensively.

Further popular swimming aids are the upper arm floating rings. These are inflatable angular and pillow-shaped floating elements through which the upper arms are inserted. Necessary additional buoyancy forces for swimming act therefore on the upper arms and handicap thereby the freedom of movement of the arms because of the large volume of the floating elements. The floating elements are located near the upper end of the human body so that when slightly moving there is the possibility that the face may dip into the water. Especially for young children this is unwanted as thereby fear and dislike of water are caused. Most upper arm floating rings contain also only one inflatable chamber so that also here exists the danger that the air may escape after contact with sharp and pointed objects, for example after contact with the edge of the swimming pool. Altogether, upper arm floating rings are useful aids for swimming instruction when the motion in the water is supported by swimming movements. However, for young children the position in the water with upper arm floating rings is too unstable and there is a danger that the surface of the upper arm floating rings may be damaged or that they are improperly handled so that the air may escape.

A further aid which is often used in swimming instruction is the swimming belt. It usually consists of pieces of cork which are strung on a rope and which are put round the chest. The pieces of cork are usually long and extend from the chest to the abdomen so that only a less stable swimming position is reached. The bearer of a swimming belt is forced into a horizontal swimming position, which is desired in a swimming lesson and which position should then be balanced and stabilized. For young children this swimming aid is not proper because for example there is no device to stabilize a side movement which is difficult to control and to balance.

A swimming and bathing aid in a wider sense is a life jacket which is normally designated as an emergency device. Life jackets consist of a sort of jacket with inflatable chambers. Life jackets are not designed as swimming and bathing aids because they restrict very much the freedom of movement by their size.

There is another known method (DE-OS No. 27 49 628) of applying floating elements to proper places at the body of physically disabled persons by belted adhesive strips to create a stable swimming position. This swimming aid is not proper for non-swimmers and especially for children because the lift augmenting elements may be slipped off unwillingly so that the additional necessary buoyancy is missing.

A further known swimming aid (DE-OS No. 28 37 497) consists of a bathing suit with emergency floating elements which can be inflated in an emergency case. The emergency floating elements correspond to a swimming ring which is integrated in the bathing suit and on which additional floating elements for a side stabilization may be arranged which extend under the armpits.

This emergency bathing suit is provided for good swimmers who dare to swim far off the shore. The swimmer may rest a while when the floating elements are inflated whereby the floating elements which restrict the freedom of movement do not disturb the swimmer. The emergency floating elements are here secured against slipping off; in general the shown embodiment is not suitable for children because of the restriction of the movements and the tightness caused by the floating elements.

A floating element equipment for the swimming introduction which is provided specially for young children is known from DE-OS No. 20 43 531. As a complete nonswimmer and beginner the pupil is here surrounded by various supports and stabilizing bubbles which maintain him in a horizontal stable swimming position. Such swimming aids are not suitable for children as they restrict free and unforced bathing.

It is further known (US Pat. No. 3,181,184) to provide a swimming and bathing aid which consists of upper arm floating rings and a ring applied round the chest. In other words known upper arm floating elements and a chest floating ring are combined. Because each element must be fixed at the body with separate strips it takes a long time to apply the swimming and bathing aid. The buckles of the belts can be reached without any difficulty and so they may be opened by young children thereby one floating element after the other may be taken off and the desired safety for young children does not exist. Further the individual floating elements consist of inflatable chambers which walls may be hurt at a sharp edge of a swimming pool so that the air escapes and the buoyancy of such an element is cancelled. Also by this method there is only a limited safety for young children. The belts of the individual floating elements cannot be tightened very strongly otherwise they cut into the skin or reduce the blood circulation so there is the danger that the individual elements are simply stripped off.

The object of the invention is to provide a swimming and bathing aid which is absolutely safe, has good features as regards comfort in wearing and particularly does not in any way restrict the freedom of movement of the wearer.

This object is solved by a swimming and bathing aid according to the present invention.

According to one aspect of this invention, a combination of two upper arm floating elements and a chest ring is provided, whereby the upper arm floating elements are connected with the chest ring by means of connection elements. Such an arrangement greatly increases safety. The chest ring which alone can create the necessary buoyancy force for swimming cannot be stripped off willingly or unwillingly because of the connection with the upper arm floating elements contrary to a normal swimming ring. Therefore an unwatched young child cannot take off the chest ring without knowledge and will of a person in charge. For stripping off the chest ring the arms would have to be lifted whereby the upper arms are guided into a horizontal position so that the chest ring is lifted and not stripped off. As long as the chest ring is not unusually large and wide it cannot be stripped off over the head because the upper arm floating elements which are connected to the upper arms are blocking.

The swimming and bathing aid is suitably sized in this way that the chest ring is worn in a high position at the chest; respectively that the chest ring is lifted by the connected upper arm floating elements. Therefore for a person using the swimming and bathing aid an essentially vertical "standing" stable swimming position is caused. In this position (without movement of the swimmer) and upper arm floating elements shall not (or only a little) dip into the water so that these elements do not cause any buoyancy or only a little buoyancy. Only when moving in the water and when side tipping moments are caused, the upper arm floating elements dip into the water and therefore have the effect of lateral stabilisation arms; that means that the upper arm floating elements effect against lateral tipping. A swinging forward and backward around the axis - upper arms shoulder-is possible and desirable to get the young children familiar with the water. Contrary to a swimming aid which consists only of upper arm floating elements, the upper arms in the normal (standing) swimming and bathing position are not forced and therefore the free movement of the arms for example for games with a ball, are not restricted. The desired "standing" stable swimming position when the chest ring is worn above the center of gravity prevents toppling over.

The invention will be better understood by reference to the accompanying drawings in which.

Figure 1:
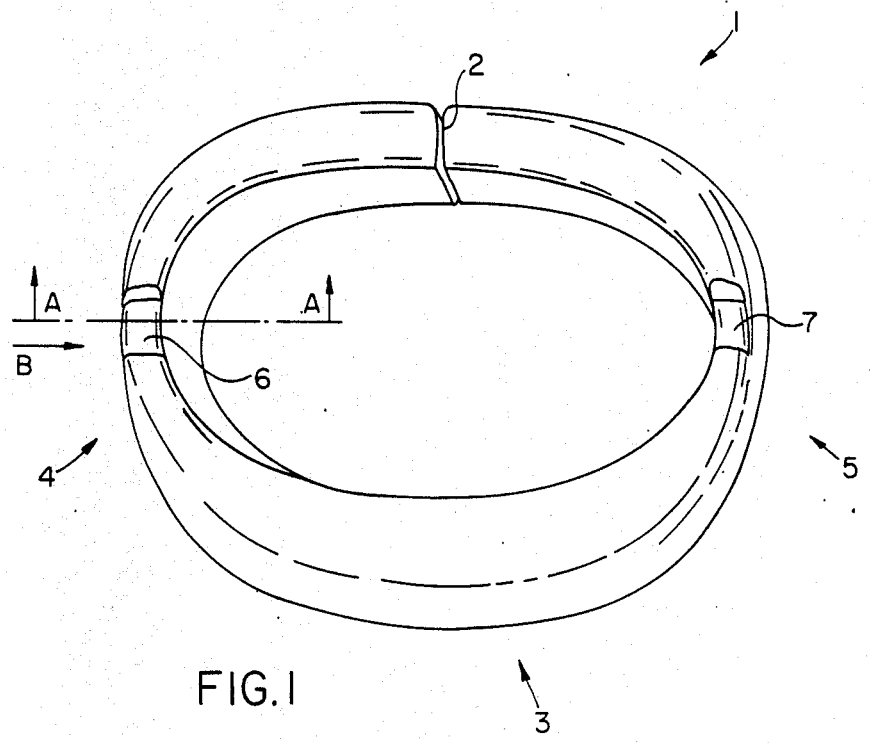
FIG. 1 is a plan view showing a chest ring

FIG. 1 shows a chest ring 1 which is formed of a warming plastic material with cellular structure. The chest ring 1 is divided by a gap 2. The chest ring 1 is inherently stable but nevertheless resilient so that it can be stretched at the gap 2 but in the unforced state it takes again the shown shape. The rearward part of the chest ring 1 with gap 2 which is placed at the child's back has an approximately rectangular cross section whereby the longside of the rectangle extends in the direction of the axis of the chest ring. The front portion 3 of the chest ring 1 has more volume and is bulged. The ratio of volume between the front and the rear portion is chosen in such way that a buoyancy is created in the ratio of $\frac{2}{3}:\frac{1}{3}$. By this ratio a secure, approximately standing, swimming position is achieved whereby the undesired dipping-in of the face with the openings of the respiratory organs is prevented because of the higher buoyancy at the front side of the chest ring 1.

Figure 2:
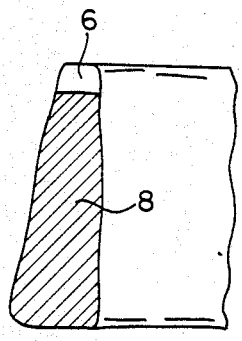
FIG. 2 is a sectional view passing through line A—A of FIG. 1.

From the rear to the front side the cross section of the chest ring 1 turns from a rectangle to a trapezoid whereby the upper part of the chest ring 1 reduces. This cross section is shown in FIG. 2 which shows a section along line A—A of FIG. 1. The left and right side 4, 5 of the chest ring 1 is placed under the arm pits in the applied state. Because of the narrow cross section with the reduced diameter in the upper part of the chest ring 1 the freedom of movement for the arms is only minutely restricted. It is essential that the reduction at these positions is not so narrow that the chest ring may here be broken. It would be possible to provide narrow bars of relatively rigid material at the left and right side 4, 5 to connect a frontward and backward floating body whereby an annular form is created with no restriction of the freedom of movement for the arms. This possible embodiment however is more complicated and more expensive. It is not necessary that the chest ring 1 has much volume at the left and right side to cause there buoyancy forces. The embodiment according to the FIG. 1 causes at its sides only some buoyancy forces so that less lateral stability is achieved. To increase the freedom of movement for the arms there is only some side stabilisation of the chest ring 1 provided but this stabilisation is provided by the following arm floating elements.

Figure 3:
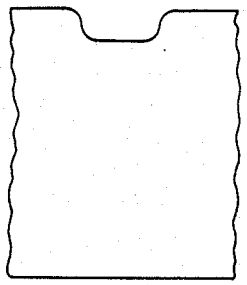
FIG. 3 is a plan view on a part of the chest ring in the direction along the arrow B—B.

At the upper side of the chest ring 1 at the left and right side 4, 5 there are recesses 6, 7 which serve as a protection against sliding for a strip described below. As you can see from FIG. 2 and FIG. 3 the recesses 6, 7 are only at the upper portion of the chest ring 1 and do not go round the whole chest ring body 8. It has been proven that the protection of the recesses 6, 7 at the upper portion of the ring body 8 is sufficient and a recess round the body is not necessary. A round recess would diminish the material of the chest ring under the arm pits.

Figure 4:
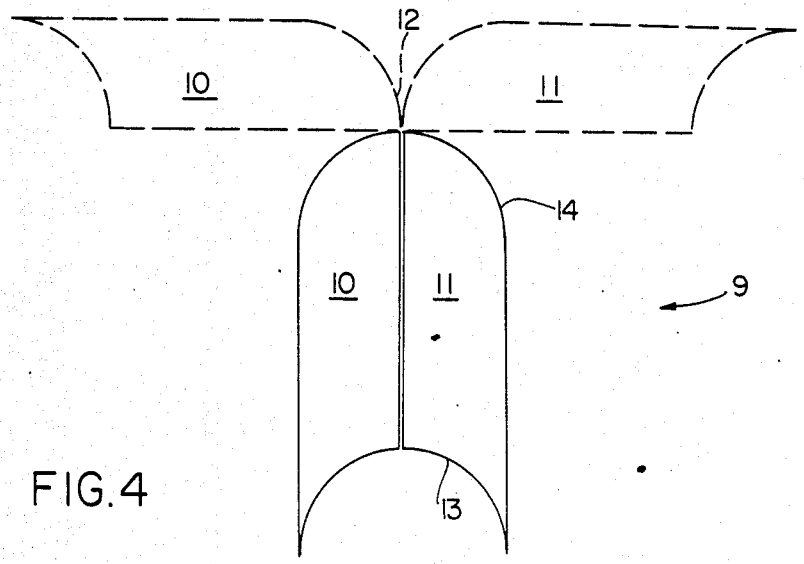
FIG. 4 is a principal view of an arm floating element in an unmounted and mounted state.

FIG. 4 shows a principle view of the embodiment of alarm floating element 9. Two bodies 10, 11 of plastic material are shown in broken lines which bodies could be connected by a bar at position 12. The bodies 10, 11 have the shape of parallelepipeds; essential is that both side parts extend to the outer side in the shown slanting form. To produce a completed arm floating element 9 (solid line) the bodies 10, 11 are clapped together through which the lower side gets an inside bulged contact surface 13. These contact surfaces 13 shall be placed at the upper arms of the bather and therefore respectively be formed according to the size of the upper arms. The shown shape of the bodies 10, 11 provide at the upper side 14, a surface bulged to the outer side according to the contact surface 13. This is appropriate for the mounting and leads to a good appearance; but this is in principle not necessary, thus meaning that this upper surface may be flat.

Figure 5:
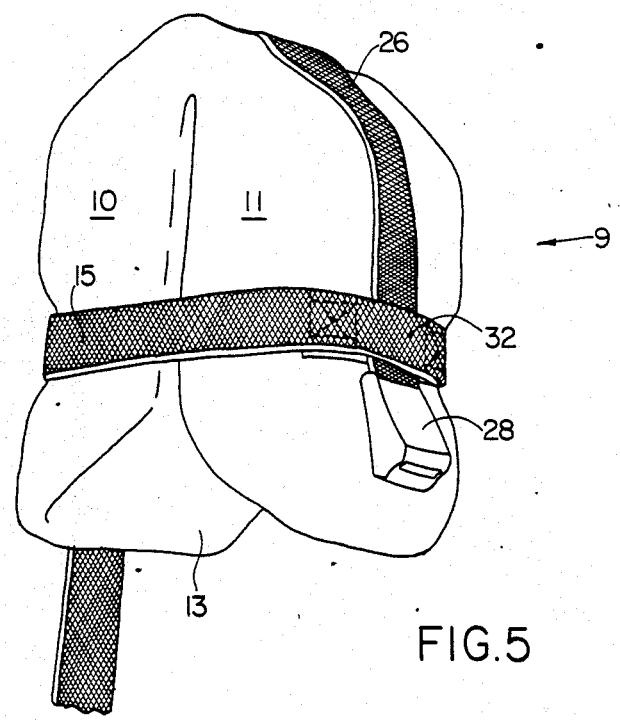
FIG. 5 is a view on a completely mounted arm floating element.

FIG. 5 shows a practical embodiment of an arm floating element 9 according to FIG. 4. Both clapped bodies 10, 11 with their contact surface 13 can be seen. The bodies 10, 11 are held together in the clapped position with a clamp strap 15.

It is advantageous and suitable to form the chest belt 1 as mentioned from plastic material with a cellular structure because therefore now larger chambers filled with air or gas are created which may be damaged so that the air may escape. The floating elements formed of plastic material are light in weight, insensitive and inherently stable to a large extent. The advantageous plastic elements are not comfortable when worn close to the skin, so that they are covered with a cloth a special stretch textile which adapts to irregular forms. The covering of the chest ring 1 is not complicated when a sleeve-shaped piece of cloth is produced according to the diameter of the chest ring 8 and which is pulled over the chest ring 1 starting at the gap 2. The open sleeve can then be sewed up so that the gap 2 is maintained also after the covering with stretch textile and the chest ring 1 can be enlarged for convenient application or (if less inherently stable) can be adapted to the circumference of the chest.

The complete form of an arm-floating element with the inward bulged contact surface 13 however is so irregular that the flexibility of a stretch textile is not sufficient for contacting all sides. Therefore the embodiment shown in FIG. 4 and 5 with two bodies 10, 11 was chosen so that the covering with stretch textile is made easier. The bodies 10, 11 are covered with the sleeve-shaped textile in the position drawn in broken lines and then clapped together. With this method the stretch textile contacts all sides as well as the inward bulged contact surface 13 of the bodies 10, 11 so that no complicated shape of stretch textile is necessary for such covering.

Figure 6:
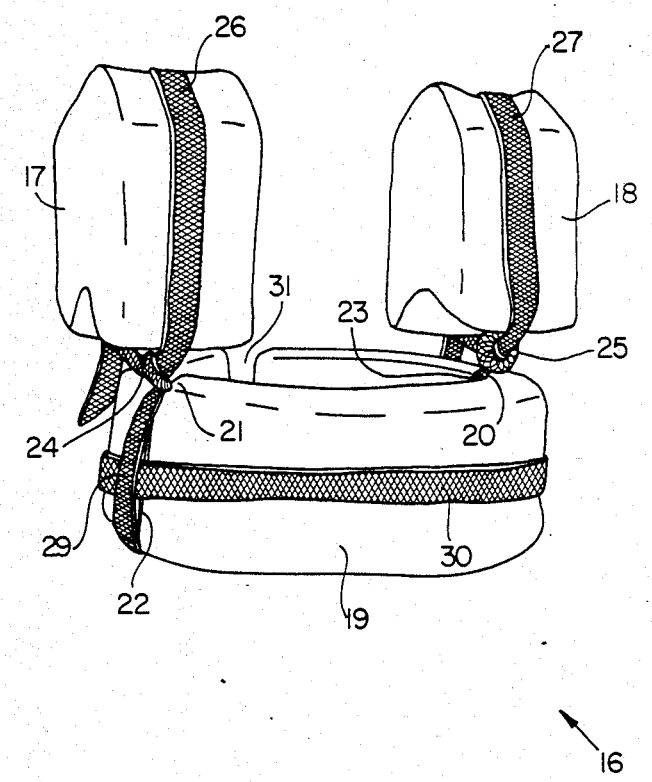
FIG. 6 is a view on a completely mounted swimming and bathing aid, FIG. 7 a view on a swimming and bathing aid in the applied state.

In a simpler embodiment naturally a chest ring 1 and arm floating elements can be provided without a cover whereby the arm floating elements 9 then could be formed of only one piece as shown in FIG. 6. It would also be possible to coat the chest ring 1 and the arm floating elements 9 with a material kind to the skin at least at those surfaces which are in contact with the skin.

FIG. 6 shows a complete mounted swimming and bathing aid in a position as though it were held at the arm floating elements 7, 18 so that the connected chest ring 19 hangs down. The arm floating elements 17, 18 are formed from only one piece in this drawing. The chest ring 19 is here built a little simpler than in FIG. 1 and has the same cross section at all position. But also at this chest ring 19 recesses 20, 21 are provided. There are annular strips 22,23 located at each side, which surround the chest ring body and engage in the recesses 20, 21 so that they cannot slip. The strips 22, 23 are sewed at their upper sides so that here loops 24, 25 are built. Through these loops 24, 25 extend strips 26, 27 which surround the arm floating elements 17, 18. The strips 26, 27 bear at their rear side a buckle 28 (shown in FIG. 5) with which the length may be adjusted.

A strip 29 is sewn to the annular strips 22, 23 by both end portions. Thereby a loop is built between the annular strip 22 and the strip 29 through which a strip 30 extends surrounding the chest ring 19. So the strip 30 is placed in the middle of the outer surface of chest ring 19. The strip 30 is adjustable in its length with a further buckle which is not visible at the rear side of the chest ring 19.

All three buckles used on the swimming and bathing aid should be of such a type that they cannot be opened by children or the opening is very difficult. Further it is advantageous to use such buckles for which both hands are needed in the opening. This hinders children taking off the swimming and bathing aid 16.

FIG. 5 shows a two-piece embodiment of an arm floating element 9 whereby the strip 26 extends through a frontward and backward loop 32 and is therefore secured against slipping. Instead of the loops, the clamp strap 15 and strip 26 could be sewn at their crossing so that a sort of cage is provided in which the bodies 10, 11 are put in.

The strips 22, 23, the strips 26, 27 and strip 30 form a harness from which the arm floating element 17, 18, the chest ring 19 and also the child who is to wear the swimming and bathing aid, are surrounded. This harness is very advantageous because it is unsuitable to connect the stretch textile of the chest ring 19 and the arm floating elements 17, 18 directly. Further it would be difficult to place connecting elements directly in the arm floating elements 17, 18 or the chest ring 19; this would hinder the covering with stretch textile and the connection itself would be insecure because of the danger that it might rip off. In comparison the proposed harness leads to a secure and moveable connection between chest ring 19 and arm floating elements 17, 18 and is used as a device to create the necessary tension.

In a modified embodiment the harness could be made in such way that the crossings between the strip 30 and the strips 22, 23 are sewn and that instead of the loops 24, 25 rigid rings are used. Further it would be possible to provide a groove at the chest ring 19 in which the strip 30 could engage. The material for the strips should be water resistent, kind to the skin and not changeable in length if wet; a suitable material is for example a plaited polyester strip.

A further embodiment cuold be with a chest ring 1, 19 without a gap 2, 31. However such a chest ring 1, 19 would not be adjustable in its width. A "growing" of the chest ring 1, 19 then would not be possible with the increasing age of a child. In FIG. 6 a embodiment with surrounding strip 30 is shown whereby the chest ring 19 with gap 31 is hindered in gaping. In a possible embodiment without strip 30 it would be necessary to provide an adjustable buckle directly at the chest ring at the gap 31. For example a lock device at the gap could also be provided by hooks or strips which could be knotted together.

Figure 7:
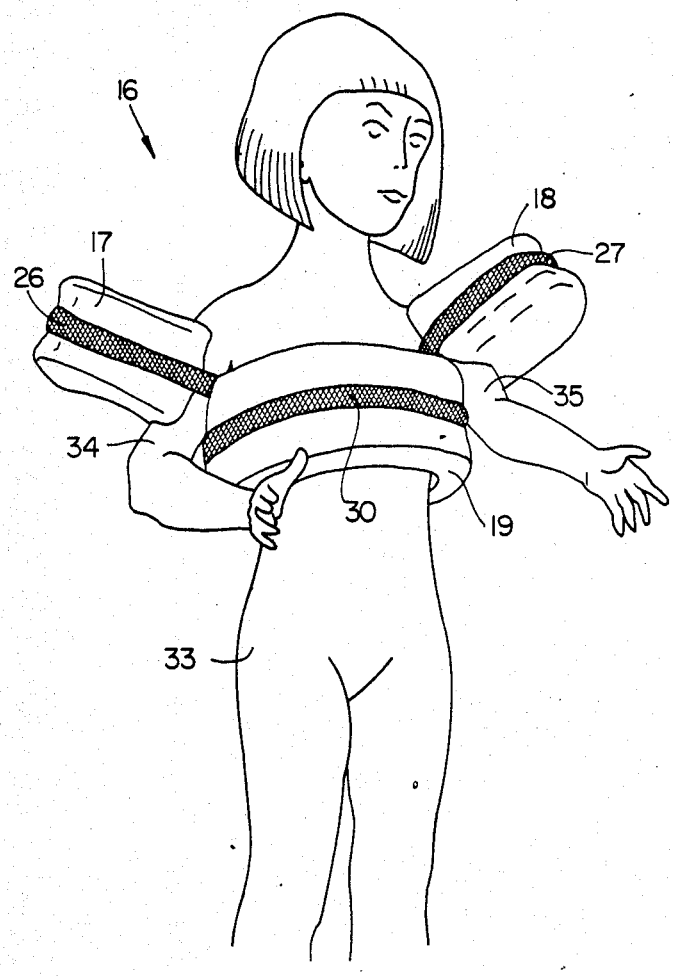

FIG. 7 shows a child 33 with an applied swimming and bathing aid 6 according to FIG. 6. Here you can see that the arm floating elements 17, 18 at the upper arms 34, 35 of the child 33 contact the upper arms 34, 35 from above and that they are held in their position by the strips 26, 27. The upper arms 34, 35 are not cut in by the strips 26, 27 because the bulged contact surfaces of the arm floating elements 17, 18 extend in a wide range at the upper arms 34, 35. Therefore the strips 26, 27 do not contact the body and lead to the (here not visible) loops 24, 25 at the strips 22, 23. When changing the length of the strips 26, 27 an adaption to different heights is possible, whereby the connection to the chest ring 19 should be chosen as short as possible so that the chest ring 19 is placed at a chest portion above the center of gravity.

The described swimming and bathing aid 16 functions as follows:

When the child 33 with an applied swimming and bathing aid 16 goes into the water is is held in a vertical "standing" swimming position by the buoyancy of the chest ring 19. The arm floating elements 17, 18 do not dip into the water so that in this position no buoyancy comes from the arm floating elements 17, 18. The vertical "standing" swimming position causes less anxiety and is suitable for most games in the water. If the child 33 moves itself, swinging movements forward and backward and to both sides are made. Movements to the side are difficult to balance and cause therefore the most anxiety. These movements are restricted by the swimming and bathing aid because of the arm floating elements 17, 18. At a side movement for example to the left side the arm floating element 18 dips more and more into the water and provides therefore (progressivly the more it dips into the water) an increasing restoring force. So swinging movements to the sides are possible but wider amplitudes are braked and restored so that the head with the sensitive ears does not dip into the water. However, swinging movements forward and backward are not so difficult to balance and are desired to make the child familiar with the water and to prepare the child for later swimming without any aid. It is very inconvenient and causes a lot of anxiety if the child dips into the water with its face, with eyes, mouth and nose. This is prevented by the embodiment where the buoyancy volume is placed in the ratio $\frac{2}{3}:\frac{1}{3}$ at the front and rear side of the chest ring 19. The child 33 therefore can swing more backward then forward in relation to the face.

The described swimming and bathing aid 16 is secure and prevents bathing accidents and can be worn conveniently without restricting movements. The connection between the arm floating elements and the chest ring is separable so that the swimming and bathing aid can be separated. When the swimming and bathing aid is used in a swimming lesson the introduction starts with a complete swimming and bathing aid as long as the swimming movement have been learnt. In a following advanced state the chest ring and the arm floating elements can be used separatly till the pupil can swim.

I claim:

1. A swimming and bathing aid for a human, comprising:

main buoyancy means, comprising a chest ring situated around the chest of a user and mostly above the center of gravity of the user, for providing buoyancy for generally maintaining the user in a vertical position, with such buoyancy being biased for generally preventing the face of the user from entering water; and supplemental buoyancy means, comprising a pair of arm floating elements situated respectively above and generally maintained in contact with the upper arms of the user for generally following same while being secured to respective side portions of said main buoyancy means, for providing a force, progressive with increasing lateral movement of the user, directed to restore the user to said vertical position; wherein said arm floating elements are substantially block-shaped and contact the outer sides of the user's upper arms with defined contact surfaces; and further wherein said arm floating elements are each respectively surrounded by a first strip which also surrounds the upper arms of the user and secures said arm floating elements to said chest ring.

2. An aid according to claim 1 wherein said chest ring and arm floating elements comprise plastic material with cellular structure.

3. An aid according to claim 2, wherein any one of said chest ring or arm floating elements are covered by a stretchable cloth which is smooth to the skin of a user and not water absorbent.

4. An aid as in claim 1 wherein said chest ring has an oval-shaped inner diameter.

5. An aid as in claim 1 wherein said chest ring defines a gap at its defined rear side and comprises resilient material having a predetermined shape but permititng flexing at said gap.

6. A swimming and bathing aid according to claim 5 wherein said chest ring further comprises a locking device for holding together its ends at said gap.

7. A swimming and bathing aid according to claim 6 wherein said chest ring is surrounded by a strip associated with said locking device.

8. A swimming and bathing aid according to claim 1, wherein said buoyancy provided by said main buoyancy means is distributed around said user in such a way that about $\frac{2}{3}$ of said buoyancy is provided at the front of the user and that about $\frac{1}{3}$ of said buoyancy is provided at the rear of said user, thereby providing the biasing for said buoyancy to prevent the face of the user from entering water.

9. A swimming and bathing aid according to claim 8 wherein said chest ring has flat sides with a reduced diameter at an upper portion thereof.

10. A swimming and bathing aid according to claim 1 wherein said contact surface is generally concave to mate with the shape of the user's upper arms.

11. A swimming and bathing aid according to claim 1 wherein said arm floating elements each comprise two separable members held together by a clamp strap to thereby define said contact surfaces of said arm floating elements.

12. A swimming and bathing aid according to claim 1 wherein said securement between said arm floating elements and said chest ring is separable.

13. A swimming and bathing aid according to claim 1 wherein said chest ring is surrounded by second strips at both sides and said second strips include each a loop at their upper sides through which said first strips of said arm floating elements extend.

14. A swimming and bathing aid according to claim 13 wherein said second strips engage a recess defined by said chest ring.

15. A swimming and bathing aid according to claim 14 wherein said first and second strips are associated with a third strip around said chest ring to form a connected harness.

16. A swimming and bathing aid according to claim 15, wherein the connections between said first and second strips and said third strip are formed by loops through which said strips pass.

17. A swimming and bathing aid according to claim 16 wherein all of said strips comprise plaited polyester strips.

18. A swimming and bathing aid for a person, comprising:

a generally annular chest ring of buoyant material disposed about the chest of a person and generally beneath the person's armpits and above the person's center of gravity, and defining a gap therein disposed substantially adjacent the person's back, said ring generally maintaining the person in a vertical position in water for swimming and bathing therein; and a pair of generally block-like arm floating members of buoyant material secured to said chest ring with respective first strips which also surround the respective arm floating members and the person's upper arms so that such members are disposed above the person's upper arms, respectively, in contact with the outer sides of same for following movement therewith, said block-like arm floating members being adapted for generally conforming to the shape of the person's arms for contacting same with defined contact surfaces thereof, and for providing increasing buoyancy thereto as such arms progressively enter water, and such increasing buoyancy providing a force to the person for also generally maintaining same in a vertical position in water for swimming and bathing therein.

* * * * *